US008685607B2

(12) United States Patent
Chung et al.

(10) Patent No.: US 8,685,607 B2
(45) Date of Patent: Apr. 1, 2014

(54) CONTINUOUS PROCESS FOR MANUFACTURING TONERS

(75) Inventors: Joo T. Chung, Webster, NY (US); Chieh-Min Cheng, Rochester, NY (US); Zhen Lai, Webster, NY (US); Mark E. Mang, Rochester, NY (US); Eugene F. Young, Rochester, NY (US); Brian Andaya, Ontario, NY (US); Joseph Leonardo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/597,749

(22) Filed: Aug. 29, 2012

(65) Prior Publication Data

US 2014/0065537 A1 Mar. 6, 2014

(51) Int. Cl.
*G03G 9/093* (2006.01)

(52) U.S. Cl.
USPC ..... 430/110.2; 430/137.14; 430/137.18; 430/137.19; 430/137.21; 430/108.1; 430/108.2; 430/108.21; 430/108.23

(58) Field of Classification Search
USPC ..... 430/137.18, 137.19, 137.21, 110.2, 430/137.14, 108.23, 108.1, 108.2, 108.21
See application file for complete search history.

(56) References Cited

U.S. PATENT DOCUMENTS

| | | | | |
|---|---|---|---|---|
| 3,847,604 | A | 11/1974 | Hagenbach et al. | |
| 4,295,990 | A | 10/1981 | Verbeek et al. | |
| 4,883,736 | A | 11/1989 | Hoffend et al. | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,330,874 | A | 7/1994 | Mahabadi et al. | |
| 5,556,727 | A | 9/1996 | Ciccarelli et al. | |
| 5,556,732 | A * | 9/1996 | Chow | 430/137.1 |
| 6,063,827 | A | 5/2000 | Sacripante et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,459,258 | B2 | 12/2008 | Chung et al. | |
| 7,943,687 | B2 | 5/2011 | Faucher et al. | |
| 2006/0222991 | A1 | 10/2006 | Sacripante et al. | |
| 2008/0138738 | A1 * | 6/2008 | Chung et al. | 430/137.14 |
| 2010/0248119 | A1 * | 9/2010 | Young et al. | 430/108.2 |
| 2010/0310979 | A1 * | 12/2010 | Ou et al. | 430/108.2 |
| 2010/0316946 | A1 * | 12/2010 | Faucher et al. | 430/108.23 |
| 2010/0330487 | A1 * | 12/2010 | Veregin et al. | 430/108.4 |

* cited by examiner

*Primary Examiner* — Mark F Huff
*Assistant Examiner* — Olatunji Godo
(74) *Attorney, Agent, or Firm* — Oliff PLC

(57) ABSTRACT

The continuous process for manufacturing toners disclosed herein includes continuously feeding components of a toner composition into a feed section of a screw extruder at a controlled rate. The continuous process for manufacturing toners may include feeding the components of a toner composition into the feed section of a screw extruder without performing an external or secondary dispersion step. That is to say, the components of the toner composition may be fed directly into the extruder without using dispersions of individual components as used in batch processes. Rather, the toner components are added to the extruder in dry form, melt-mixed, and may be dispersed in aqueous form in the extruder. The process may produce micron-sized toner particles, thus no further size reduction may be necessary.

20 Claims, 4 Drawing Sheets

CONTINUOUS PROCESS FOR MANUFACTURING TONERS

TECHNICAL FIELD

This disclosure relates to a process for manufacturing toner compositions. More specifically, this disclosure relates to continuous processes for producing an aqueous chemical toner without aggregation and coalescence processes.

BACKGROUND

Processes and devices for preparing toner composition and pre-toner mixtures used in toner compositions are known. For example, processes for preparing toner compositions are generally disclosed in U.S. Pat. No. 4,883,736 to Hoffend et al. and U.S. Pat. No. 7,459,258 to Chung et al., the disclosures of which are totally incorporated herein by reference. Examples of commercially known processes may include melt blending of pre-toner mixtures in a twin screw extruder compounder (available from Corperion Corporation, Ramsey, N.J.) and in a dispersion of pigment and wax in aqueous phase in a batch stirred tank.

Batch processes may be used for preparing chemical toners in an aqueous phase, which involves a high temperature emulsification of molten wax stirred in a vessel followed by homogenization in a homogenizer, such as for example, a Gaulin homogenizer.

Batch processes require long processing times and consume a great deal of energy. Multiple passes through the homogenizer may be required to obtain a desired level of emulsion and to ensure uniformity and size of the toner particle prepared using batch processes. However, even after multiple passes, obtaining a desired level of emulsion, uniformity, and size is not guaranteed. It is difficult to produce batch-to-batch consistency and scale-up the batches due to different batch reactions. Batch processes also require constant attention because an entire batch may have to be aborted if a batch process runs out of control in terms of temperature, impeller speed, and the like.

Therefore, there is a need for improved toner producing processes, that is, continuous aqueous chemical toner processes for preparing toner compositions. In addition, there is a need for processes that provide more control of the particles produced, including maintaining quality, uniformity, and size, without the extensive time and energy used in batch process methods.

SUMMARY

Embodiments disclosed herein include a continuous process for manufacturing aqueous chemical toners using a twin screw extruder. The process herein may eliminate the need for conventional chemical toner-making batch process steps of, for example, pre-mixing, aggregation, coalescence, etc. Embodiments of the continuous aqueous chemical toner process disclosed herein use a twin screw extruder instead of a batch reactor and an impeller. The process may include co-feeding toner components into the extruder through a central hopper; melt-mixing the co-fed toner components; and adding a neutralization agent and a surfactant solution to the extruder to initiate a neutralization reaction. The melt-mixed toner components may react with the neutralization agent and the surfactant solution to create a water-in-oil dispersion, which may form the core structure of the toner. A shell latex may be added downstream to protect the core structure of the toner. DI water may be injected into the extruder, for example, for phase inversion so that the water-in-oil emulsion changes to an oil-in-water emulsion, producing an aqueous chemical toner slurry without aggregation and coalescence steps. This process, therefore, simplifies conventional chemical toner batch manufacturing processes.

BRIEF DESCRIPTION OF THE DRAWINGS

For a better understanding of the present embodiments, reference may be had to the accompanying figures.

DETAILED DESCRIPTION

Figure 1:
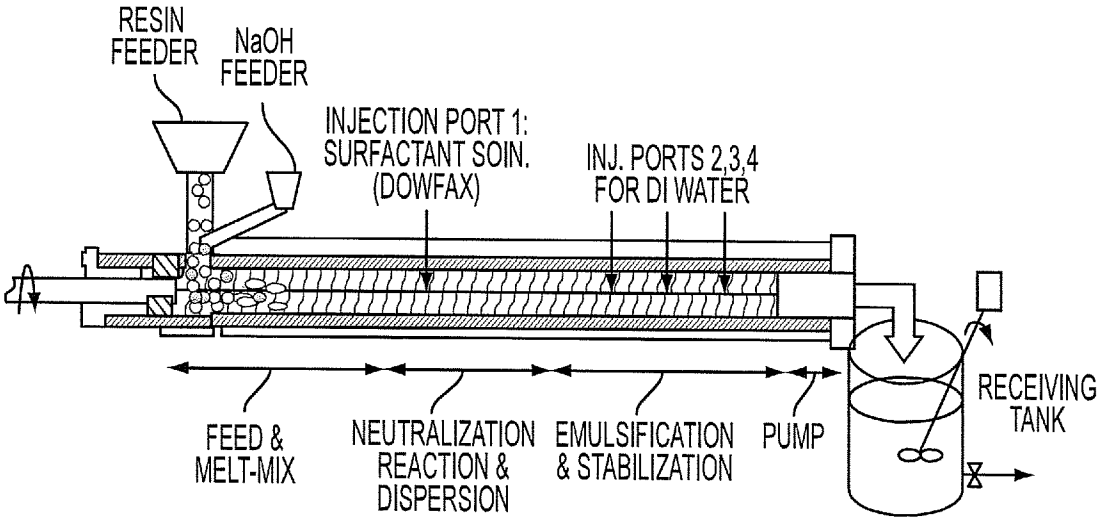
FIG. 1 PRIOR ART
FIG. 1 is a schematic of continuous aqueous solvent-free resin emulsification using twin screw extruder.

Embodiments of the continuous process for manufacturing aqueous chemical toners disclosed herein may overcome variations such as batch-to-batch inconsistency due to large variations in temperature, shear field, pumping capacity, and the like, usually seen in batch reactors. Batch processes handle bulk quantities and, thus, the malfunction of process controls in a batch process results in the abortion of large quantities of materials. The disclosed continuous process for manufacturing aqueous chemical toners may reduce waste in the event of a malfunction of process controls by processing a small quantity of toner continuously under tight control.

In addition, embodiments of the process eliminate various steps of conventional toner-making batch processes. For example, embodiments of the process disclosed herein eliminate the need to prepare pre-process dispersions of the toner components prior to feeding the toner components into an extruder. Thus, the continuous process for manufacturing aqueous chemical toners may prepare toner more efficiently, more consistently, and less expensively than conventional toner-making batch processes. The disclosed process also reduces inventory because it may produce toner "just-in-time."

Embodiments of the continuous process for manufacturing aqueous chemical toners disclosed herein may comprise continuously feeding dry toner components into a feed section of a screw extruder at a controlled rate. The continuous feeding of dry toner components may comprise feeding the toner components into the feed section of a screw extruder without first performing an external or secondary dispersion step. That is to say, the toner components may be fed as dry components directly into the extruder without first forming a dispersion. Thus, embodiments of the continuous process for manufacturing aqueous chemical toners may use commodity resins, pigments, and wax, rather than pre-made latex, pigment, or wax dispersions. Therefore, the cost of making the toner may be drastically reduced because forming dispersions of latex, pigment, wax, and other components from commodity materials may be expensive.

Embodiments of the continuous process for manufacturing aqueous chemical toners may comprise emulsification after dry toner components are melt-mixed in the upstream of an extruder; adjustment of a ratio of neutralizing agent, surfactant, and DI water in the downstream of the extruder, along with adjustment of extrusion conditions such as temperature, screw speed, feed rate of toner components, to produce target micron-sized toner particles. In this manner, fully formulated toner particles with desired particle size exit the extruder, for example, as an aqueous slurry. The aqueous slurry may then be fed into a downstream unit operation such as wet sieving to sieve out coarse particles, washing to wash out any surfactant, drying to eliminate any moisture, adding a dry additive blend for charge control of toners, and screening to eliminate agglomerate of the toner. Obtaining fully formulated toner particles with desired particle sizes from the exit of the extruder may eliminate batch processes of premixing, aggregation, and coalescence, thereby eliminating three giant batch reactors. Unlike batch processes, embodiments of the process disclosed herein minimize waste by containing the materials inside the extruder in the event that any equipment controls malfunction during the process; reduce energy cost by handling a smaller amount of materials at one time, and are more environment-friendly because a solvent is not used.

Embodiments of the continuous process for manufacturing toners disclosed herein may be used to produce toner compositions comprising a resin, an optional colorant, an optional wax, and other optional additives. These components, as described below, may be co-fed into a twin screw extruder as dry ingredients at a pre-determined rate. The components may be melt-mixed in the upstream portion of the extruder. The melt-mixed components may then be emulsified in the downstream portion of the extruder. Neutralization and stabilization reactions may be induced. After the toner particles of the toner compositions have reached a desired size, the toner composition may be pumped, such as in an aqueous slurry, into a washing system.

Continuous Process

Embodiments of the continuous process for manufacturing toners may include, but are not limited to, the following. For example, each of the toner component materials may be co-fed into a central feed hopper by individual toner component feeders to form a dry-blended mixture. The feeding of each toner component material is controlled independently based on the toner formulation. The dry-blended mixture of toner component materials may be fed to an extruder through the central feed hopper. The dry-blended mixture may be melt-mixed in the extruder to produce a molten-phase mixture. A neutralizing agent, a surfactant, and DI water may be added to the downstream of the extruder.

The extruder may have segmented barrels and the temperature, as well as other process parameters, of each barrel section may be controlled independently. For example, the heating and cooling of each barrel may be controlled independently.

The screw elements of the extruder may be segmented for ease of design and to meet particular mixing dynamics at different sections of the extruder for particular reactions, and proper dispersions such as neutralization reactions, water-in-oil dispersions, stabilization, and phase inversion to produce toner particles having a desired size, such as micron-sized toner particles. Embodiments of the process disclosed herein may produce a fully-formulated toner with desired particle sizes, such as micron-sized particles, that exits the extruder, for example, as an aqueous slurry.

As discussed above, conventional batch chemical toner processes include secondary or external process steps of forming a dispersion or emulsion, for example a pigment dispersion, a latex dispersion, a wax dispersion, or a latex emulsion. Due to expensive equipment and high energy consumption, manufacturing external or secondary dispersions may be costly. Eliminating these costly steps represents a significant cost saving opportunity when manufacturing high quantities of toner.

Embodiments of the continuous chemical toner process disclosed herein may eliminate the need to form, for example, colorant dispersions, resin dispersions, wax dispersions, or a latex emulsion prior to feeding components into an extruder. Instead, the components of a toner, such as commodity resins, colorants, and waxes, may be fed independently into an extruder through a central feed hopper to form a dry-blended mixture that may be fed directly into the extruder. That is to say, the individual toner component materials may be fed into the extruder without the need for a pre-process dispersion.

Additionally, the neutralizing agent that is fed independently to the central feed hopper may be a bead form neutralizing agent. The bead form neutralizing agent may be added directly to the extruder. Thus, all of the toner component materials may be dry (e.g., fed to the extruder without first foaming a dispersion or emulsion).

FIG. 1 is a cross-section schematic diagram of a continuous resin emulsification process for a dry resin being processed through an extruder with water and surfactant. The result is a nano-sized latex dispersion suitable for use in an emulsion aggregation process for a chemical toner.

Figure 2:
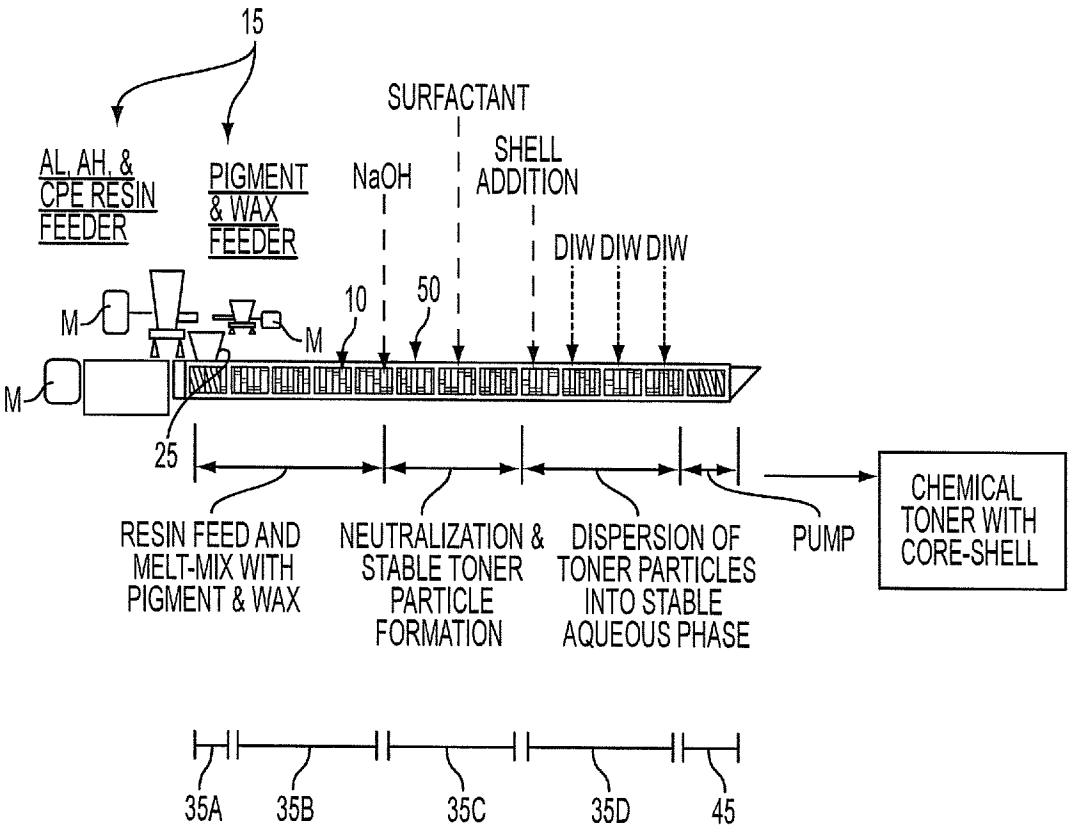
FIG. 2 is a schematic of a continuous aqueous chemical toner process used to perform embodiments of the process disclosed herein.

FIG. 2 is a cross-section schematic diagram of an embodiment of the continuous process for manufacturing aqueous chemical toners. Embodiments of this process use a screw extruder 5, shown as a multi-screw extruder, to which the each dry toner component material may be fed. The multi-screw extruder may be a twin-screw extruder. A twin-screw extruder may be used in various applications. For example, a twin screw extruder may provide types of mixing such as distributive mixing, dispersive mixing, dissipative mixing, chaotic mixing, and pumping. A twin screw extruder allows commodity resins, pigments, and waxes to be co-fed into the twin screw extruder at a defined rate, melt-mixed in an upstream portion of the extruder, and emulsified in the downstream portion of the extruder.

The extruder may include a segmented barrels and screws. As discussed above, process parameter, such as the heating and cooling of each segment, may be controlled independently and may function as a continuous reactor. The screws may be segmented for screw design, to meet specific process requirements, and to provide adequate mixing. Different types of screw elements may be used to design the screw.

The length/diameter (L/D) ratio of the extruder may be lengthened or shortened. In addition, mixing intensity, shear stress, and shear rate may be adjusted by proper screw design to meet desired mixing dynamics for particular processes. For example, the mixing may be distributive, dispersive, dissipative, and/or chaotic. Fill volumes, local pressure, feed rate, may be controlled by varying screw speeds.

In embodiments, individual dry toner component materials 15 according to the above description may be fed into the screw extruder 5 through a central feed hopper 25 at a controlled rate. After being fed into the screw extruder 5, the individual dry toner component materials 15 pass through a feed section 35A, discussed below, of the extruder 5 to segment 35B, discussed below, where heat and shear may be applied for melt-mixing of the individual toner component 15 to produce a molten phase. A neutralization agent and a surfactant solution may be fed in a second segment 35C, discussed below, to the melt-mixed molten phase in the extruder after the toner component materials are melt-mixed. In the second segment 35C, the water in the surfactant solution triggers a neutralization reaction and a water-in-oil dispersion occurs with surfactant. Shell latex may be added following the surfactant injection. The DI water may be added at different positions downstream of the extruder to facilitate phase inversion of the toner from a water-in-oil dispersion to an oil-in-water dispersion to produce aqueous toner slurry as it passes into segment 35D of the extruder 5. There, extrusion conditions, such as, for example, a barrel temperature of from about 90° C. to about 120° C., such as from about 95° C. to about 115° C., or from about 100° C. to about 110° C.; a screw speed of from about 100 to about 350 rpm, such as from about 110 to about 340 rpm, or from about 120 to about 330 rpm; and a feed rate of from about 5 to about 15 lbs/hr, such as from about 7 to about 12 lbs/hr, or from about 8 to about 10 lbs/hr. The extrusion conditions may be adjusted to provide toner particles having a desired size, such as micron-sized toner particles. The toner particles produced from the processes disclosed herein may have a diameter of from about 3.8 μm to about 10 μm, such as from about 3.8 μm to about 8 μm, or from about 3.8 μm to about 5 μm.

A fully-formulated toner with a desired particle size, such as a micron-sized toner, may exit the extruder, for example, as an aqueous slurry at the end 45 of the extruder 5 and may be analyzed for uniformity and particle size.

The extruder 5 comprises a screw shaft 10 that may be connected to a motor (not shown) through gear box (not shown) to turn the screw. The screw speed may be accurately controlled by the motor and the gear box. A barrel 50 provides a housing for the screws, which may be used for mixing, dispersing, emulsifying, and homogenizing in embodiments of the continuous process under different conditions. Both the barrel 50 and screw 10 may be segmented and each section may be heated and controlled independently at a desired temperature. Controlling the processing temperature may be much easier and accurate, unlike large batch stirred tanks, which involve heating and controlling very large masses, because the screws of extruder 5 may be segmented for proper screw design for particular process application. The multiple segments may be each heated to a temperature of from about 30° C. to about 400° C., such as from about 40° C. to about 350° C., or from about 50° C. to about 300° C. The ability to set different temperature profiles along the barrel allows much better control of particle size and uniformity, which is not achieved in batch processes.

In addition, processes using the extruder 5 may be contained and aborted if any process control malfunctions occur during any part of the continuous process. Another benefit to the continuous processes is that only a small amount of material during processing must be discarded because the extruder may contain the material to be discarded in extruder, such as in the case of process control malfunctioning. In contrast, batch processes must discard an entire batch upon a qualifying malfunction.

As discussed above, the dry components may be added to the extruder through a hopper 25 in the feed section 35A of the extruder 5. Prior to the feeding, the toner components may be dry-blended for a period of about 15 minutes to about 45 minutes. The dry pre-toner mixture may be added at a controlled rate. The feed rate may be from about 1 to about 30 lb/hr, such as from about 5 to about 25 lb/hr, or from about 10 to about 20 lb/hr.

After passing through feed section 35A, the pre-toner mixture may pass to segment 35B, where heat and shear may be applied to produce a molten phase mixture through a melt mixing. Segment 35B may be heated to a temperature of from about 90° C. to about 120° C., such as from about 95° C. to about 115° C., or from about 100° C. to about 110° C. In segment 35B, a high shear stress is applied at low barrel temperatures and at high shear rates to induce dissipative mixing, which accelerates the melt-mixing and the incorporation of all individual ingredients and the uniform distribution of neutralization agent. The total residence time for the process from feeding the toner components to the extruder to the toner, such as in an aqueous toner slurry, exiting the extruder is from about 120 seconds to about 180 seconds.

The molten-phase mixture may enter a second segment 35C of the extruder 5 and, there, may be mixed with a neutralization agent and a surfactant solution injected in the downstream of the extruder, which triggers a neutralization reaction with the neutralization agent that is melt-mixed into the molten phase of the toner component materials. The neutralizing agent may be present in an amount of from about 0.1 to about 2.5 parts per hundred (pph), such as from about 0.2 to about 2.0 pph, or from about 0.5 to about 1.5 pph. The surfactant may be present in an amount of from about 1 to about 10 pph, such as from about 1.5 to about 9 pph, or from about 2 to about 8 pph. In this section, the surfactant solution may be injected at low pressure and drop at an increased residence time to create a water-in-oil dispersion.

The dispersion may then be coated with a shell latex to create a core-shell morphology by, for example, injecting shell latex in a specific portion of the extruder. Shells may be applied to toner cores using the extruder at a later date.

The particles may be mixed with DI water (DIW) injected along a downstream portion of the extruder in segment 35D as shown in FIG. 2 to maximize dispersion of the toner size colloid particles in aqueous phase. In this section, phase inversion occurs from water-in-oil to oil-in-water dispersion for stabilization of the aqueous dispersion of the toner, which becomes aqueous toner slurry.

The aqueous toner size colloid is then pumped through pumping zone of the extruder and collected for washing at the end 45 of the extruder 5.

Resin

Toners of the present disclosure may include any resin suitable for use in toner. Such resins, in turn, may be made of any suitable monomer. Suitable monomers for forming the resin may include, but are not limited to, acrylonitriles, diols, diacids, diamines, diesters, diisocyanates, combinations thereof, and the like. Any monomer employed may be selected depending upon the particular polymer to be used.

In embodiments, the polymer used to form the resin may be a polyester resin. Suitable polyester resins may include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entireties. Suitable resins may also include a mixture of an amorphous polyester resin and a crystalline polyester resin as described in U.S. Pat. No. 6,830,860, the disclosure of which is hereby incorporated by reference in its entirety.

One, two, or more resins may be used in forming a toner. In embodiments where two or more resins may be used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, a suitable toner of the present disclosure may include an amorphous resin and a crystalline polyester resin. The weight ratio of the resins may be from about 98% amorphous resin/2% crystalline resin, to about 70% amorphous resin/30% crystalline resin, in embodiments from about 90% amorphous resin/10% crystalline resin, to about 85% amorphous resin/25% crystalline resin.

The resins may be present in an amount of from about 65 to about 95 percent by weight, or from about 70 to about 90 percent by weight, or from about 75 to about 85 percent by weight of the toner composition (that is, toner particles exclusive of external additives).

The crystalline resin may be a polyester resin formed by reacting a diol with a diacid or diester in the presence of an optional catalyst. For forming a crystalline polyester, suitable organic diols may include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof; and the like. The aliphatic diol may be, for example, selected in an amount of from about 40 to about 60 mole percent, in embodiments from about 42 to about 55 mole percent, or from about 45 to about 53 mole percent of the resin.

Examples of organic diacids or diesters selected for preparing the crystalline resins may include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, from about 40 to about 60 mole percent, in embodiments from about 42 to about 55 mole percent, for example from about 45 to about 53 mole percent of the resin.

Examples of crystalline resins may include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), polypropylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly (pentylene-sebacate), poly(hexylene-sebacate), poly(octylene-sebacate), alkali copoly(5-sulfoisophthaloyl)-copoly (ethylene-adipate), poly(decylene-sebacate), poly(decylene-decanoate), poly-(ethylene-decanoate), poly-(ethylene-dodecanoate), poly(nonylene-sebacate), poly (nonylene-decanoate), poly(nonylene-dodecanoate) copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

The crystalline resin may possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Polycondensation catalysts that may be used for the crystalline polyesters may include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in amounts of, for example, from about 0.01 mole percent to about 5 mole percent based on the starting diacid or diester used to generate the polyester resin.

Suitable crystalline resins may include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

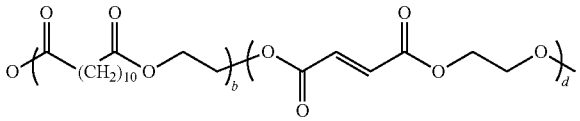

wherein b may be from about 5 to about 2000, such as from about 7 to about 1750, in embodiments from about 10 to about 1500; and d may be from about 5 to about 2000, such as from about 7 to about 1750, in embodiments from about 10 to about 1500.

In embodiments, a suitable crystalline resin used in a toner of the present disclosure may have a weight average molecular weight of from about 10,000 to about 100,000, such as from about 12,000 to about 75,000, in embodiments from about 15,000 to about 30,000.

The amorphous resin may likewise be a polyester resin formed by reacting a diol with a diacid or diester in the presence of an optional catalyst. Suitable catalysts may include the above-described polycondensation catalysts.

Examples of diacids or diesters selected for the preparation of amorphous polyesters may include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof, and the like. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols used in generating the amorphous polyester may include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof, and the like. The amount of organic diol selected may vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins may include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be used may include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be used as a resin. Examples of such resins may include those disclosed in U.S. Pat. No. 6,063,827, the disclosure of which is hereby incorporated by reference in its entirety. Exemplary unsaturated amorphous polyester resins may include, but are not limited to, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly (butyloxylated bisphenol co-itaconate), poly(co-propoxylated bisphenol co-ethoxylated bisphenol co-itaconate), poly (1,2-propylene itaconate), and combinations thereof. In embodiments, the amorphous resin used in the core may be linear.

In embodiments, a suitable amorphous polyester resin may be a poly(propoxylated bisphenol A co-fumarate) resin having the following formula:

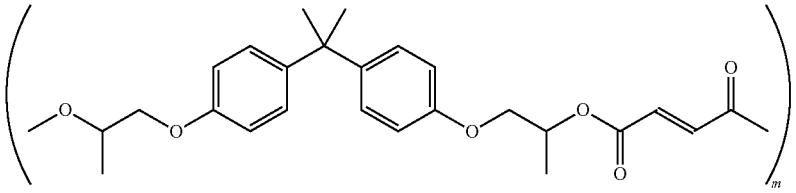

wherein m may be from about 5 to about 1000, such as from about 7 to about 750, in embodiments from about 10 to about 500. Examples of such resins and processes for their production may include those disclosed in U.S. Pat. No. 6,063,827, the disclosure of which is hereby incorporated by reference in its entirety.

An example of a linear propoxylated bisphenol A fumarate resin which may be used as a resin is available under the trade name SPARII from Resana S/A Industrias Quimicas, Sao Paulo, Brazil. Other propoxylated bisphenol A fumarate resins that may be used and are commercially available may include GTUF and FPESL-2 from Kao Corporation, Japan, XP777 from Reichhold, Research Triangle Park, N.C. and the like.

In embodiments, a suitable amorphous resin used in a toner of the present disclosure may have a weight average molecular weight of from about 10,000 to about 100,000, such as from about 12,000 to about 75,000, in embodiments from about 15,000 to about 30,000.

In embodiments, a resin coating may be applied to the core toner particles to form a shell thereover. Any resin described above as suitable for forming the toner resin may be used as the shell.

In embodiments, resins which may be used to form a shell may include, but are not limited to, crystalline polyesters described above, and/or the amorphous resins described above for use as the core. For example, in embodiments, a polyalkoxylated bisphenol A-co-terephthalic acid/dodecenylsuccinic acid/trimellitic acid resin, a polyalkoxylated bisphenol A-co-terephthalic acid/fumaric acid/dodecenylsuccinic acid resin, or a combination thereof, may be combined with a polydodecanedioic acid-co-1,9-nonanediol crystalline polyester resin to form a shell. Multiple resins may be used in any suitable amounts.

Neutralizing Agent

The neutralizing agent may be any suitable neutralizing agent to neutralize acid groups in the resins such as, for example, a neutralizing agent disclosed in U.S. Pat. No. 7,943,687 to Faucher et al., filed on Jul. 14, 2009. For example, suitable neutralizing agents may include both inorganic basic agents and organic basic agents. Suitable basic agents may include, for example, ammonium hydroxide, potassium hydroxide, sodium hydroxide, sodium carbonate, sodium bicarbonate, lithium hydroxide, potassium carbonate, combinations thereof, and the like. Suitable basic agents may also include monocyclic compounds and polycyclic compounds, having at least one nitrogen atom, such as, for example, secondary amines, which may include aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines, and combinations thereof. In embodiments, the monocyclic and polycyclic compounds may be unsubstituted or substituted at any carbon position on the ring.

A basic agent may be used so that it may be present in the pre-toner mixture in an amount of from about 0.001% by weight to 50% by weight of the resin, in embodiments from about 0.01% by weight to about 25% by weight of the resin, in embodiments from about 0.1% by weight to 5% by weight of the resin.

As discussed above, the neutralizing agent may be added to a resin possessing acid groups. The addition of the neutralizing agent may thus raise the pH of an emulsion including a resin possessing acid groups from about 5 to about 12, in embodiments, from about 6 to about 11.

Colorant

Various suitable colorants of any color may be present in the toners, including suitable colored pigments, dyes, and mixtures thereof. The colorant may be added to the pre-toner mixture in an amount sufficient to impart the desired color to the toner. For a color toner, a pigment or dye may be selected, for example, in an amount of from about 2 to about 10 percent by weight, or from about 2 to about 15 percent by weight of the toner composition. For a black toner, the pigment or dye may be added in an amount of from about 3 to about 10 percent by weight of the toner composition.

Colorants used in the continuous toner process disclosed herein may include, for example, REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that may be selected are cyan, magenta, or yellow pigments or dyes, and mixtures thereof. Examples of magentas that may be selected may include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Other colorants may be magenta colorants of (Pigment Red) PR81:2, CI-45160:3. Illustrative examples of cyans that may be selected may include copper tetra(octadecyl sulfonamido)phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected may include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Forum Yellow SE/GLN, Cl Dispersed Yellow 33 2,5-dimethoxy-4-sulfonanilide phenylazo-4'-chloro-2,5-dimethoxy acetoacetanilides, and Permanent Yellow FGL, PY17, CI-21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

Waxes

Waxes with, for example, a low molecular weight $M_w$ of from about 1,000 to about 10,000, such as polyethylene, polypropylene, and paraffin waxes, may be included in, or on toner compositions as, for example, fusing release agents.

Surfactants

Other additives, such as surfactants may be added to the toner. One, two, or more surfactants may be used. The surfactants may be selected from ionic surfactants and nonionic surfactants. Anionic surfactants and cationic surfactants are encompassed by the term "ionic surfactants." In embodiments, the surfactant may be used so that it may be present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that may be used may include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108.

Anionic surfactants which may be used may include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants may include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used in embodiments.

Examples of the cationic surfactants, which are usually positively charged, may include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Developer

The toner particles formed from the continuous process disclosed herein may then be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer (although values outside of these ranges may be used). In embodiments, the toner concentration may be from about 90% to about 98% by weight of the carrier (although values outside of these ranges may be used). However, different toner and carrier percentages may be used to achieve a developer composition with desired characteristics.

Carrier

Illustrative examples of carrier particles that may be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used.

In embodiments, polyvinylidenefluoride and polymethylmethacrylate (PMMA) may be mixed in proportions of from about 30 weight % to about 70 weight %, in embodiments from about 40 weight % to about 60 weight % (although values outside of these ranges may be used). The coating may have a coating weight of, for example, from about 0.1 weight % to about 5% by weight of the carrier, in embodiments from about 0.5 weight % to about 2% by weight of the carrier (although values outside of these ranges may be obtained).

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles (although values outside of these ranges may be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside of these ranges may be used), coated with about 0.5% to about 10% by weight, in embodiments from about 0.7% to about 5% by weight (although amounts outside of these ranges may be obtained), of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although concentrations outside of this range may be obtained). However, different toner and carrier percentages may be used to achieve a developer composition with desired characteristics.

The embodiments described herein were shown to provide aggregation control and uniformity in which desired particle size, particle size distribution and shape factor were obtained.

Imaging

Toners formed from the continuous processes disclosed herein may be used in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device using a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside of these ranges may be used), after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

Example 1

Example 1 produced small particle size toner with a D50 particle size of 4.3 μm. The toner components and pre-blend resins (25.3% high Mw amorphous Polyester, 25.3% low Mw amorphous Polyester, and 6.8% Crystalline Polyester) were fed in one feeder. 9% pigment and 5.5% wax pre-blend were added to the other feeder. The resins, pigment, and wax were co-fed into an extruder through a central feeder. The toner components were melt-mixed to form a molten phase.

1.0 pph of NaOH beads were fed into the extruder, followed by a surfactant solution (4.8 molal concentration at the injection point) at a controlled temperature of 95° C. at a 6.5 kg/hr pre-blend resin feed rate at 250 rpm to form a water-in-oil dispersion, for forming the core structure of the chemical toner. 28% of shell latex was fed into the extruder after the core structure of the toner was formed. Then, DI water was added for facilitating phase inversion from a water-in-oil emulsion to an oil-in-water emulsion at 50° C. to produce an aqueous chemical toner slurry.

Figure 3:
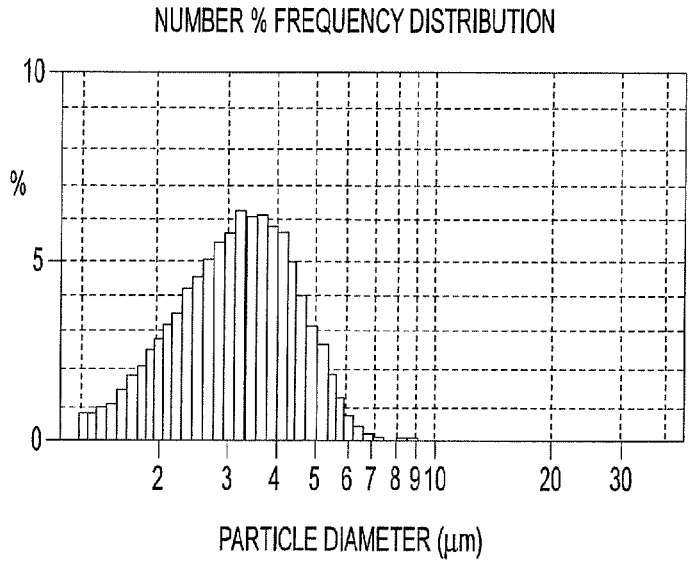
FIG. 3 shows particle size and size distribution of toners produced in Example 1.
Figure 3:
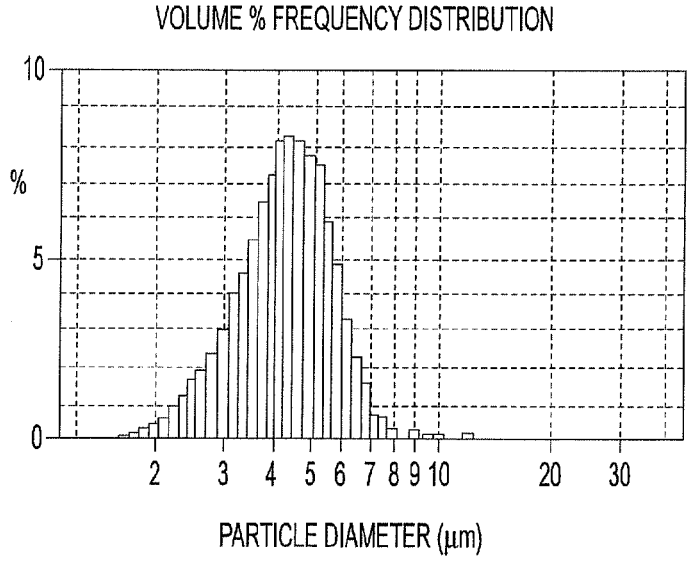

The particle size distribution of toner particles of Example 1 are shown in Table 1 and FIG. 3.

Example 2

Example 2 produced a toner slurry with a D50 particle size of 5.97 μm. Pre-blend resins (25.3% high. Mw amorphous Polyester, 25.3% low Mw amorphous Polyester, and 6.8% Crystalline Polyester) were fed in one feeder, and 9% pigment and 5.5% wax pre-blend were fed in another feeder. The resins, pigment, and wax were co-fed into an extruder through a central feeder. The toner components were melt-mixed to form a molten phase.

0.8 pph of NaOH beads fed into extruder followed by a surfactant solution (3.2 molal concentration at the injection point) at a controlled temperature of 95° C. at 6.5 kg/hr pre-blend resin feed rate at 250 rpm to form water-in-oil dispersion, for forming the core structure of the chemical toner. 28% of shell latex was fed into the extruder after the core structure of the toner was formed. DI water was added to the extruder to facilitate phase inversion from a water-in-oil emulsion to an oil-in-water emulsion to produce aqueous chemical toner slurry at 60° C.

Figure 4:
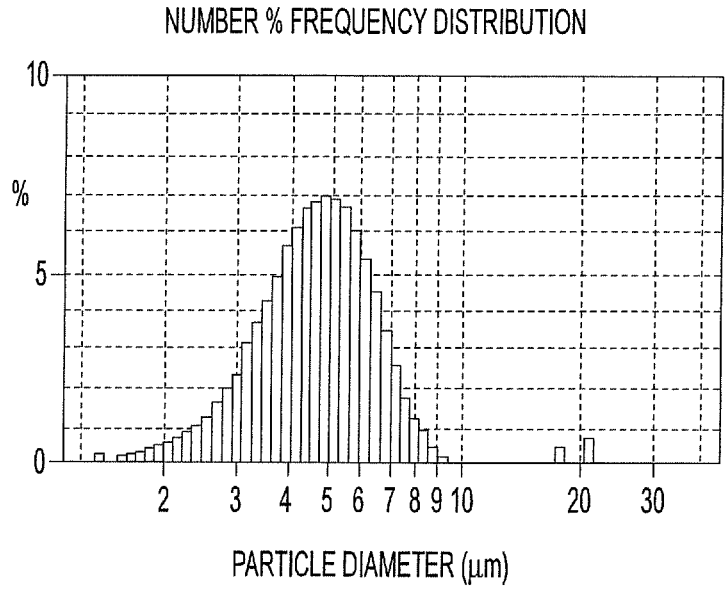
FIG. 4 shows particle size and size distribution of toners produced in Example 2.
Figure 4:
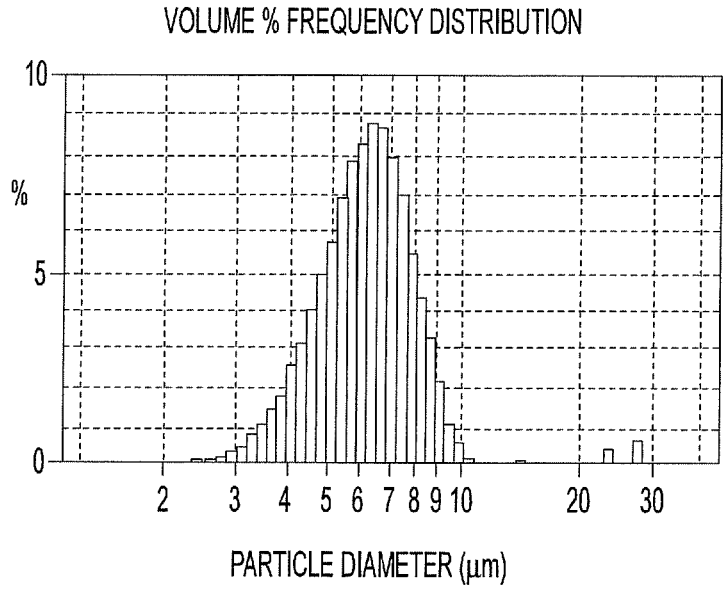

FIG. 4 shows the results of this trial and demonstrates the process disclosed herein produces micron-sized particles of a fully formulated toner. For DIAM30 and DIAM32, the volume percent between 1.40 μm and 3.17 μm was 17.41, the volume percent between 5.00 μm and 12.00 μm was 45.36, and the volume percent between 12.70 μm and 42.00 μm was 15.23. The particle size distribution of toner particles of Example 2 are shown in Table 1 and FIG. 4.

TABLE 1

| | | 16% | 84% | Volume Ratio 50/16 | Volume Ratio 84/50 |
|---|---|---|---|---|---|
| Example 1 | DIAM10 | 2.16 | 4.43 | 1.486 | 1.381 |
| | DIAM30 | 3.2 | 5.54 | 1.348 | 1.285 |
| | DIAM32 | | | | |
| Example 2 | DIAM10 | 3.28 | 6.23 | 1.416 | 1.339 |
| | DIAM30 | 4.52 | 7.6 | 1.321 | 1.271 |
| | DIAM32 | | | | |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A continuous process for making a toner, the process comprising:

co-feeding toner components into an extruder through a central hopper as dry toner components;

melt-mixing the toner components in the extruder;

feeding a dry neutralization agent into the extruder containing the melt-mixed components;

forming, from the neutralized components, a core toner particle in the extruder; and coating the core toner particle with a shell latex in the extruder to form a fully-formulated coated toner particle having a core-shell structure.

2. The continuous process according to claim 1, the process further comprising collecting the fully-formulated coated toner particle having a core-shell structure as it exits the extruder.

3. The continuous process according to claim 2, wherein the fully-formulated coated toner particle has a particle size of from about 3.8 μm to about 10 μm.

4. The continuous process according to claim 2, wherein the process does not include aggregation and coalescence.

5. The continuous process according to claim 1, wherein the extruder includes segmented barrels, and the melt-mixing is performed in a segment that is heated to a temperature of from about 80° C. to about 120° C. and that has a screw speed of from about 150 rpm to about 350 rpm.

6. The continuous process according to claim 1, wherein the toner components are co-fed into the extruder at a rate of from about 1 to about 30 lb/hr.

7. The continuous process according to claim 1, wherein the process further comprises dry-blending the toner components for a period of about 15 minutes to about 45 minutes before co-feeding the toner components into the extruder, and after co-feeding the toner components into the extruder, a total residence time for the process to form the toner particle having the core-shell structure is from about 120 seconds to about 180 seconds.

8. The continuous process according to claim 1, wherein melt-mixing the toner components includes a form of mixing selected from the group consisting of distributive mixing, dispersive mixing, dissipative mixing, and chaotic mixing.

9. The continuous process according to claim 8, wherein melt-mixing the toner components includes dissipative mixing of the components, feeding the neutralization agent into the extruder includes a dispersive mixing of the melt-mixed toner components and the neutralization agent in the extruder.

10. The continuous process according to claim 1, wherein the toner components are co-fed into the extruder in powder form, without for first forming a secondary dispersion or emulsion.

11. The continuous process according to claim 1, wherein coating the core toner particle with a shell latex occurs in a specific segment of the extruder.

12. The continuous process according to claim 2, wherein no grinding is performed on the fully-formulated coated toner particle after it exits the extruder.

13. A continuous process for making an aqueous chemical toner, the process comprising:

co-feeding toner components into an extruder through a central hopper as dry toner components;

melt-mixing the toner components in the extruder;

feeding a dry neutralization agent and DI water into the extruder containing the melt-mixed components;

forming, from the neutralized components, a core toner particle in the extruder;

coating the core toner particle with a shell latex in the extruder to form a fully-formulated coated aqueous chemical toner particle having a core-shell structure; and collecting the fully formulated coated aqueous chemical toner particle as it exits the extruder.

14. The continuous process according to claim 13, wherein feeding the neutralization agent into the extruder initiates a neutralization reaction that forms a water-in-oil emulsion of the melt-mixed toner components.

15. The process according to claim 13, wherein the fully-formulated coated toner particle has a particle size of from about 3.8 μm to about 10 μm.

16. The process according to claim 13, wherein no grinding is performed on the fully-formulated aqueous chemical toner particle after it is collected from the extruder.

17. The process according to claim 13, wherein the toner components comprise a commodity resin, a commodity colorant, and a commodity wax, and the toner components are co-fed into the extruder in powder form, without first forming a secondary dispersion or emulsion.

18. The process according to claim 13, wherein coating the core toner particle with a shell latex occurs in a specific segment of the extruder.

19. The process according to claim 1, further comprising feeding a surfactant solution into the extruder containing the melt-mixed components.

20. The process according to claim 13, further comprising feeding a surfactant solution into the extruder containing the melt-mixed components.

* * * * *